United States Patent [19]

Dornak, Jr.

[11] 3,933,113

[45] Jan. 20, 1976

[54] MARINE VESSEL PROPULSION SYSTEM

[75] Inventor: Henry E. Dornak, Jr., Alvin, Tex.

[73] Assignee: Exxon Research and Engineering Company, Linden, N.J.

[22] Filed: Dec. 10, 1973

[21] Appl. No.: 423,609

Related U.S. Application Data

[63] Continuation-in-part of Ser. No. 293,284, Sept. 28, 1972, abandoned.

[52] U.S. Cl. ..... 115/12 R; 114/151

[51] Int. Cl.[2] ..... B63H 11/00

[58] Field of Search ..... 115/11, 12 R, 14, 16; 114/151

[56] References Cited

UNITED STATES PATENTS

| | | | |
|---|---|---|---|
| 2,730,065 | 1/1956 | Piper | 115/14 |
| 3,400,682 | 9/1968 | Jones, Jr. | 114/151 |
| 3,517,633 | 6/1970 | Wanzer | 114/151 |

*Primary Examiner*—Trygve M. Blix
*Assistant Examiner*—Jesus D. Sotelo
*Attorney, Agent, or Firm*—James E. Reed

[57] ABSTRACT

A marine vessel is propelled by pumping water from a water intake line through a horizontal nozzle into a first generally horizontal submerged passageway containing a venturi section and extending from an internal chamber surrounding the nozzle to a submerged outlet in the hull of the vessel and admitting supplemental water into the chamber through a second generally horizontal submerged passageway extending into the chamber from a submerged inlet in the hull of the vessel and through a generally vertical passageway extending into the chamber beneath the nozzle from a bottom inlet in the hull of the vessel.

8 Claims, 16 Drawing Figures

FIG. 1.
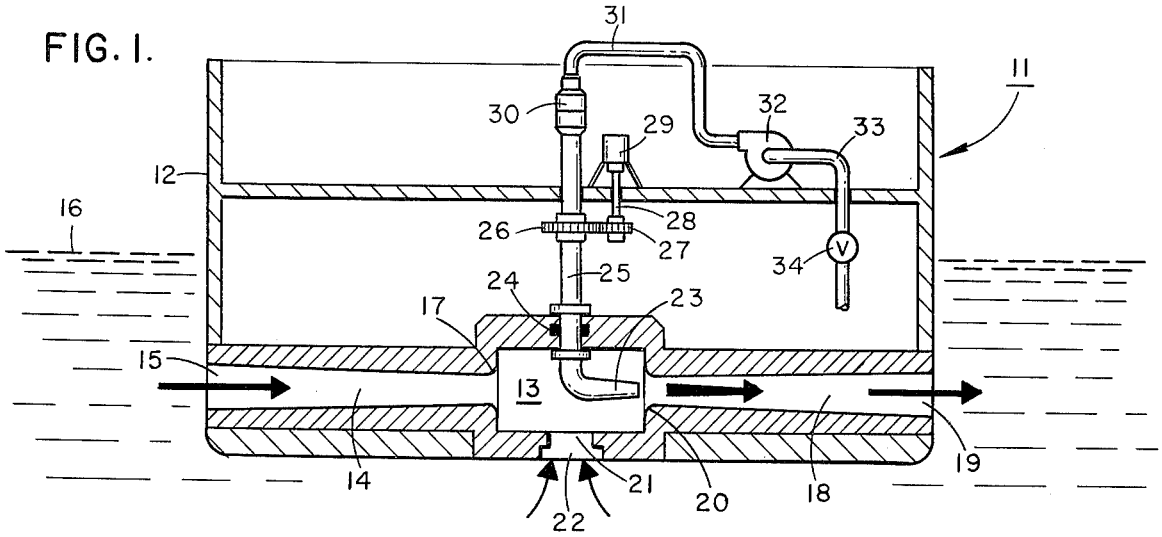
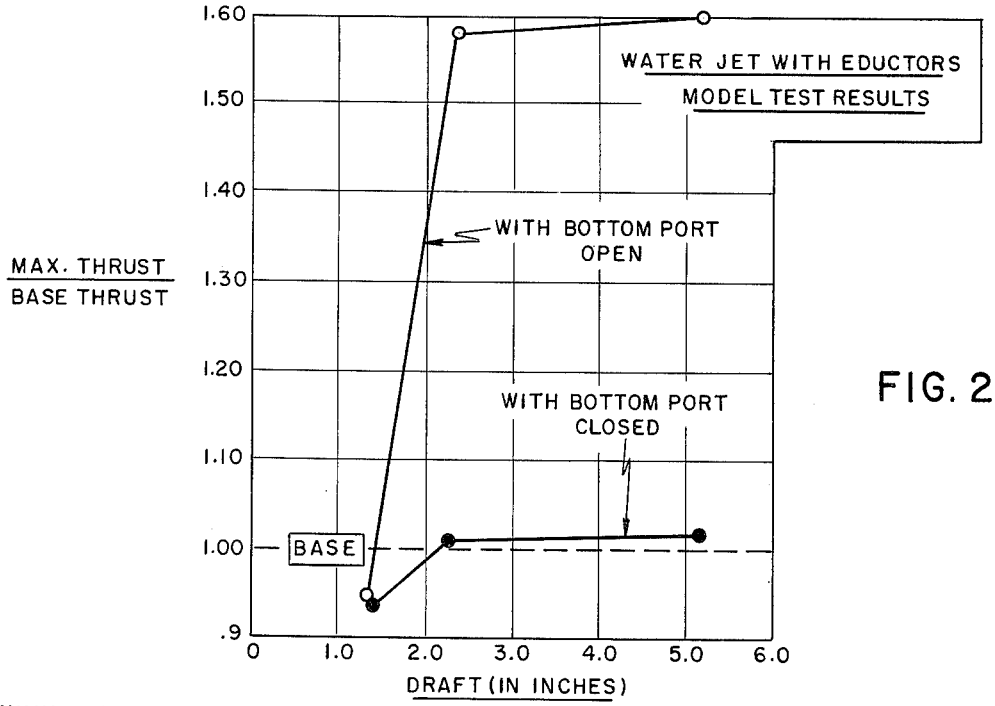
FIG. 2.
FIG. 3.
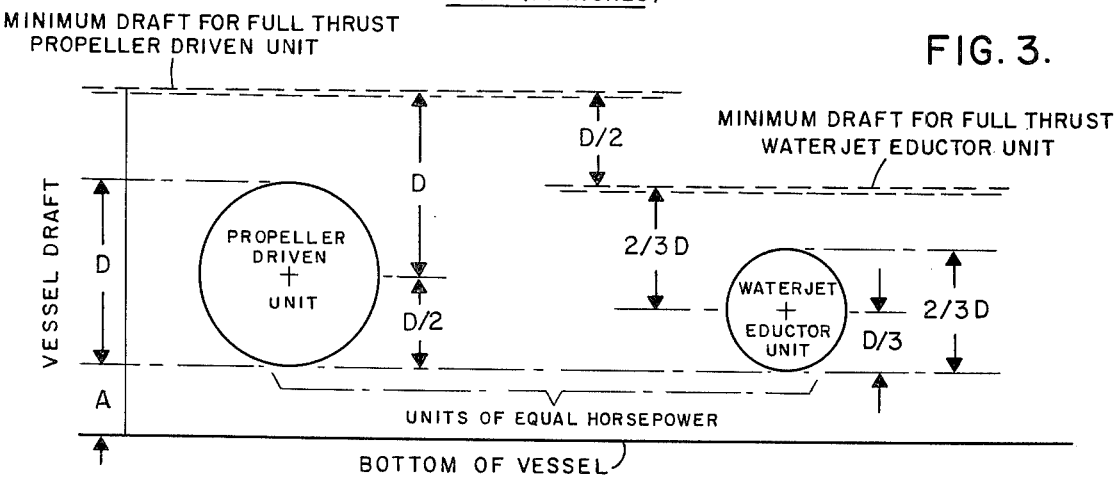

FIG. 8.
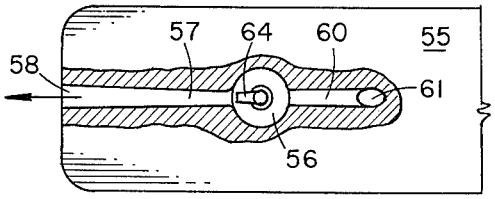
FIG. 6.
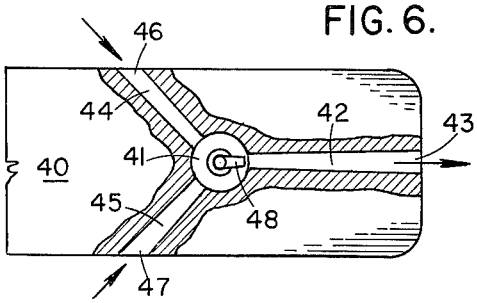
FIG. 9.
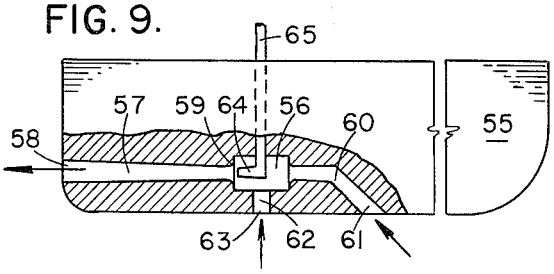
FIG. 7.
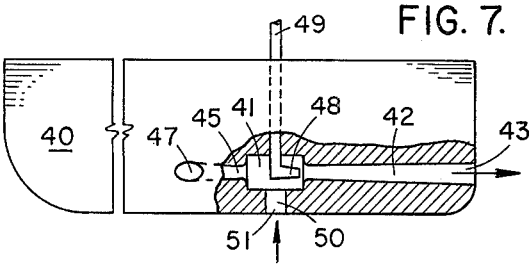
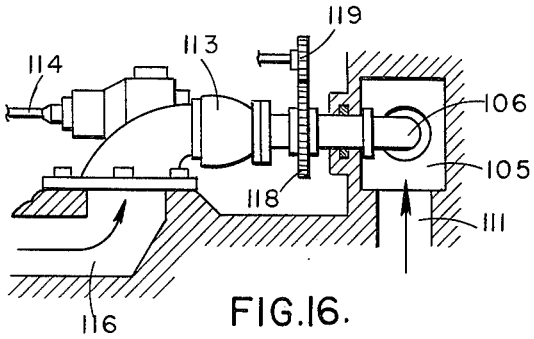
FIG. 16.
FIG. 12.
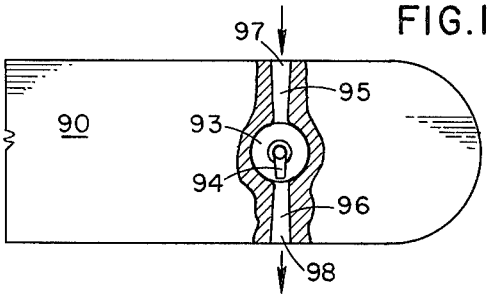
FIG. 13.
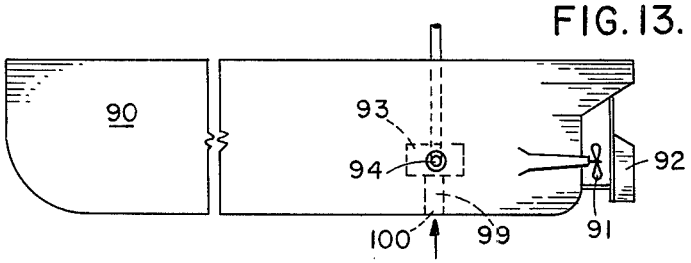
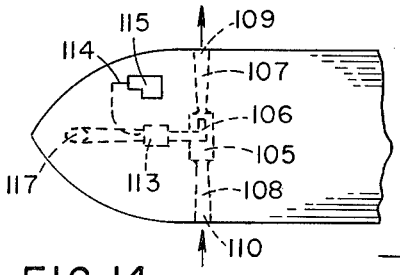
FIG. 14.
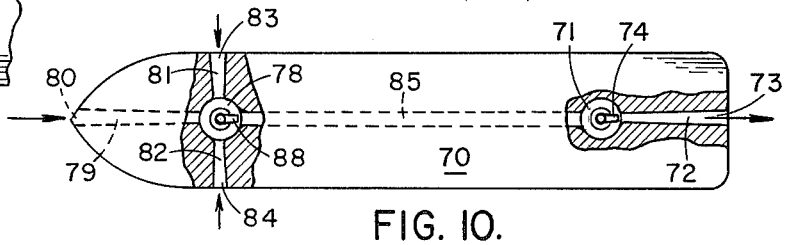
FIG. 10.
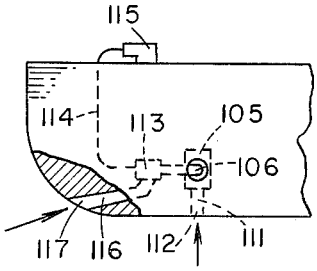
FIG. 15.
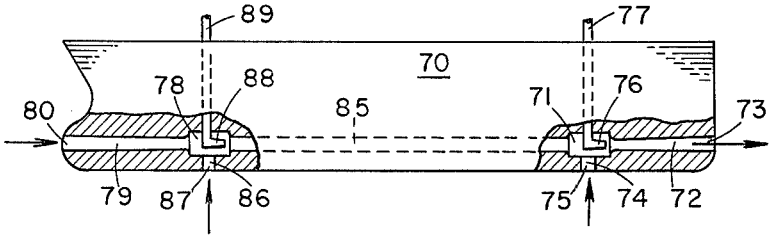
FIG. 11.

MARINE VESSEL PROPULSION SYSTEM

CROSS REFERENCE TO RELATED APPLICATIONS

This application is a continuation-in-part of application Ser. No. 293,284, filed in the United States Patent Office on Sept. 28, 1972, and now abandoned.

BACKGROUND OF THE INVENTION

1. Field of the Invention: This invention relates to the propulsion of marine vessels and is particularly concerned with a hydraulic system for providing thrust for ships and similar vessels.

2. Description of the Prior Art: Hydraulic propulsion systems in which seawater is discharged from an underwater passageway in a ship's hull to generate thrust have been used for maneuvering ships, barges and similar marine vessels. Such systems generally depend on an internal propeller to pull water into one end of a passageway and discharge it at low velocity from the other end. The volume of water which must be moved through the passageway is generally large and hence such systems are expensive to install and operate. It has been suggested that jet eductors might be used in lieu of the propellers. By pumping water through an independent line to an internal nozzle mounted near the centerline of the passageway adjacent a downstream venturi section, a differential pressure sufficiently high to induce the flow of additional water into the intake end of the passageway can be created. This results in higher mass flow and increases the thrust developed by the system. By using a rotatable nozzle and providing a venturi section on each end of the passageway, the thrust can be applied in either direction. If a passageway having two or more branches is used and provisions are made for closing off one or more branches when not in use, greater directional control and better maneuverability of the vessel can be obtained.

Although eductor systems of the type outlined above offer interesting possibilities, efforts to develop a practical system have not been encouraging. Laboratory studies and model tests have shown that the total thrust developed by such systems tends to be low. The additional water which flows into the intake end of the passageway in response to the differential pressure created in the venturi section normally gives an increase in thrust of only about 5% about that provided by water discharged through the internal nozzle alone. The total thrust can be increased by pumping more water through the nozzle but this is expensive and does not significantly improve the overall efficiency of the system. As a result, the economics of using eductor-type hydraulic propulsion systems have been marginal at best.

SUMMARY OF THE INVENTION

The present invention provides an improved hydraulic propulsion system using eductors which largely overcomes the disadvantages of systems proposed in the past. The improved system of the invention includes a generally horizontal intake passageway extending from a submerged inlet in the vessel's hull to an internal chamber located below the waterline, a nozzle positioned within the chamber, a water supply line extending to the nozzle from a pumping system having an independent intake port, a generally horizontal discharge passageway which contains a venturi section adjacent the chamber and extends from the chamber to a submerged outlet in the hull, and a bottom intake passageway extending upwardly into the chamber below the nozzle from a bottom inlet in the hull. Tests have shown that admitting supplemental water into the chamber through both the horizontal intake passageway and the bottom intake passageway simultaneously results in a surprisingly higher thrust level, for a given water rate through the nozzle, than can otherwise be obtained. The increased thrust due to the influx of additional supplemental water through the bottom intake passageway may be as much as 60% or more of the basic thrust provided by the jet nozzle alone, compared with an increase of only about 5% in systems having a horizontal intake passageway but no bottom intake passageway. The reasons for this much greater thrust augmentation are not fully understood.

As a result of the improved thrust augmentation obtained, the system of the invention provides comparable thrust-to-horsepower ratios without the disadvantages normally associated with earlier eductor systems and conventional propeller-driven systems. The improved system can be installed at lower cost than conventional propeller-driven thrusters, is more efficient than eductor systems suggested heretofore, permits the use of small hull openings which can be positioned to remain submerged at light drafts without the ballast often needed to keep conventional propeller-driven systems operable, provides a potential gain in speed over the earlier eductor systems and propeller-driven type devices, and retains about 60% of total thrust when the thrust passageway is exposed to air, compared to a complete loss of thrust with the conventional propeller-driven device. As a result of these and other advantages, the system of the invention has many potential shipboard applications.

BRIEF DESCRIPTION OF THE DRAWING

FIG. 1 in the drawing is a cross-sectional view of a marine vessel fitted with a side thruster for operation in accordance with the invention;

FIG. 2 is a graph showing the results of tests carried out in a model test basin with a model vessel operated in accordance with the invention;

FIG. 3 is a diagram illustrating the advantages of the system of the invention over conventional systems with respect to location of the propulsion system passageways;

FIG. 6 is a top view, partially in section, of the stern portion of a ship operated in accordance with the invention;

FIG. 7 is a side view, partially in section, of the vessel of FIG. 6;

FIG. 8 depicts a modification of the vessel shown in FIG. 6;

FIG. 9 is a side view of the vessel of FIG. 8;

FIG. 10 depicts still another embodiment of the invention;

FIG. 11 is a side view, partially in section, of the vessel of FIG. 10;

FIG. 12 is a top view of a vessel fitted with a stern thruster for operation in accordance with the invention and with conventional propulsion means;

FIG. 13 is a side view, partially in section, of the vessel of FIG. 12;

FIG. 14 is a schematic representation of a vessel showing the water jet pump and associated equipment used to provide power for the system of the invention;

FIG. 15 is a side view, partially in section, of the vessel of FIG. 14; and

FIG. 16 is an enlarged view of the pump and associated equipment depicted in FIGS. 14 and 15.

DESCRIPTION OF THE PREFERRED EMBODIMENTS

Figure 4:
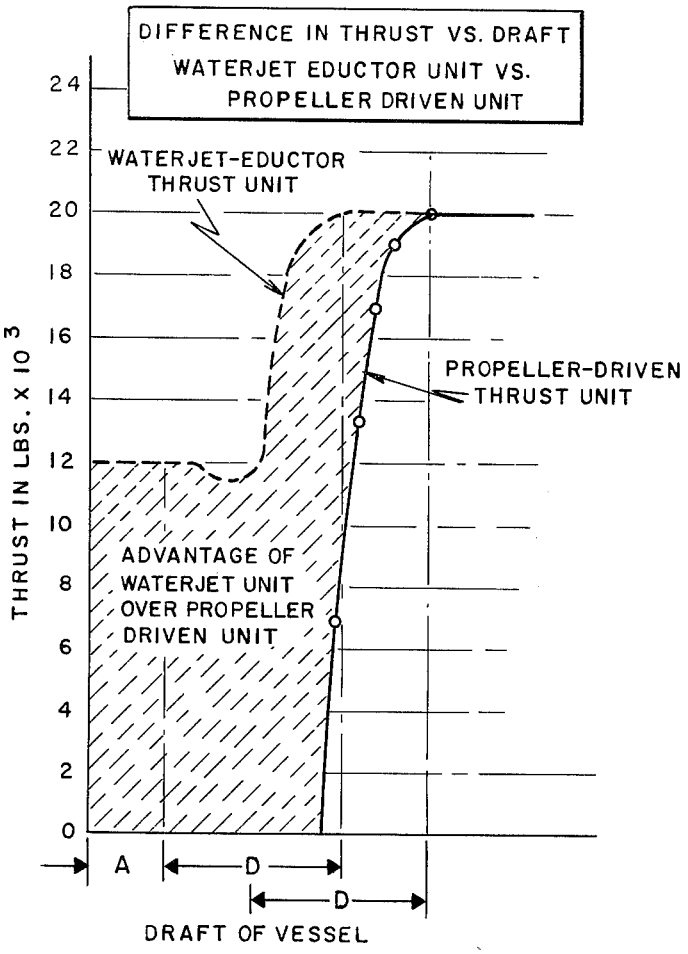
FIG. 4 shows the effect of changes in vessel draft on conventional systems and on the system of the invention.

The marine vessel 11 depicted in FIG. 1 of the drawing may be an offshore drilling ship, a pipe laying barge, a tanker, a transportation barge or a similar vessel. The hull 12 of this vessel contains an internal chamber 13 which may be located below the waterline near the stern of the vessel, near the bow of the vessel, or at some intermediate point. A generally horizontal intake passageway 14 extends into the chamber from an intake port 15 located below the surface of the water 16 and is provided with a venturi constriction or throat at its inner end as indicated by reference numeral 17. This throat section may be an integral part of the passageway or may instead be provided by means of an insert containing an orifice or similar opening of suitable configuration. Passageway 14 will normally be of circular cross-section and will usually taper inwardly toward the throat as shown. If an insert containing a venturi throat is provided, the outer portion of the passageway does not necessarily have to be of circular cross-section and may not be tapered. A generally horizontal, substantially straight discharge passageway 18 extends from chamber 13 to a submerged discharge port 19 and is provided with a venturi throat as indicated by reference numeral 20. Passageways 14 and 18 in this embodiment of the invention are aligned with one another and will normally have similar configurations so that each can be used as either an intake or a discharge passageway. A generally vertical bottom intake passageway 21 extends upwardly into chamber 13 from an inlet 22 in the bottom of the hull. This bottom intake passageway does not necessarily have to be of circular cross section and instead may be of any desired cross-sectional configuration. The dimensions of these three passageways will depend upon the volume of water which must flow through them to utilize the installed horsepower. Knowing the horsepower rating and the efficiency of the particular system selected, the necessary dimensions can be calculated.

An L-shaped nozzle of similar device 23 extends into chamber 13 between the venturi throats 17 and 20. The dimensions of the chamber are sufficiently large to permit rotation of the nozzle assembly so that the discharge end can discharge into either of the venturi sections. The upper portion of the nozzle assembly extends through the top or side of chamber 13 and is provided with suitable bearing and packing assemblies 24 to permit rotation without leakage. Line 25 is connected to the upper end of the nozzle assembly and provided with gear 26 to permit turning of the assembly from one discharge position to the other. Gear 26 is driven by a mating gear or pinion 27 which is connected by shaft 28 to an electrical or hydraulic motor or similar power source 29. The upper end of pipe 25, which serves as the water supply line to the nozzle, is connected through rotatable joint 30 to line 31 containing pump 32. The intake side of the pump is connected by line 33 containing valve 34 to a sea chest, not shown, which serves as a water source. Alternatively, a water jet pump having an independent sea suction may be connected directly to the rotatable nozzle. All of the ports in the system may be provided with screens or grids, not shown, to keep foreign materials out of the system. The system shown in FIG. 1 thus includes an internal chamber 13, a generally horizontal intake passageway 14, a generally vertical bottom intake passageway 21, a generally horizontal discharge passageway 18, and an independent line for supplying water to the nozzle 23.

During operation of the system shown in FIG. 1, water is pumped from the sea through pump 32 and lines 25 and 31 to the nozzle 23, where it is discharged at high velocity into the center of the venturi throat of discharge passageway 18. This induces the flow of supplemental water through horizontal passageway 14 and through bottom intake passageway 21 simultaneously. This supplemental water is discharged through passageway 18 and port 19 along with water from the jet nozzle. It thus serves to augment the thrust provided by the water from the nozzle. When it is desired to apply thrust in the opposite direction, pump 32 is shut down and the nozzle is rotated through an angle of 180° by actuating motor 29. The pump is then started again and water from the sea chest or other source is pumped through the nozzle and discharged into the venturi throat of passageway 14. The differential pressure created by the eductor induces supplemental water to flow into chamber 13 through horizontal passageway 18 and bottom intake passageway 21. This supplemental water augments the thrust provided by the water discharged from the nozzle. The system shown thus permits the application of lateral thrust to either the starboard or port side of the vessel.

The effect of bottom intake passageway 21 in the system shown in FIG. 1 is best illustrated by FIG. 2 in the drawing. This figure is a graph showing the results of tests carried out in a model basin. The model used in the tests was provided with a lateral passageway containing an eductor similar to that shown in FIG. 1 and with a vertical passageway extending upwardly from a port in the bottom of the hull into the eductor chamber beneath the nozzle. The model was instrumented to permit measurement of the thrust generated. In one series of tests, the bottom port in the hull was closed off by means of a cover plate and water was pumped through the nozzle with the model positioned at three different depths to represent changes in draft. The results obtained are shown by the bottom curve in FIG. 2. It will be noted that the thrust, shown in the figure as the ratio of the maximum thrust developed over the base thrust generated by the nozzle fluid alone, increased until the model draft reached a value of about 2¼ inches. At this point the submergence of the passageway was sufficient to permit the development of full thrust. Thereafter, increasing the draft of the model produced little change in the amount of thrust generated. The thrust value was only slightly greater than 1.00, indicating that the supplemental water pulled in through the horizontal passageway contributed only slightly to the total thrust developed. Following these tests, the bottom plate was removed from the model to permit the influx of water through both the horizontal and vertical passageways. With the horizontal passageways only partially submerged, the thrust generated was about the same as that obtained with the bottom plate in place. With the horizontal passageway properly submerged, however, the thrust ratio increased from about 1.00 to nearly 1.60. A further increase in the draft of the model produced a slight additional increase in thrust. It can thus be seen that inclusion of the bottom intake resulted in a surprising increase in an amount of thrust obtained. This 60% increase in thrust represents a significant advantage for the system of the invention over earlier eductor systems not having a bottom intake passageway below the eductor.

Additional model tests similar to those described above have shown that the cross-sectional area and configuration of the bottom intake passageway are not highly critical. In these later tests, runs were made with a circular bottom intake passageway 1.625 inches in diameter, with a rectangular bottom intake passageway measuring 3 inches by 2.4 inches, with a rectangular bottom intake passageway measuring 4 inches by 2.4 inches, and with no bottom intake passageway. These latter tests showed that the thrust augmentation obtained with the three different bottom intake passageways was about the same, despite the differences in cross-sectional area, and that in each case the total thrust obtained was significantly higher than that developed without any bottom intake passageway.

In still another test, the model vessel was modified by arranging the jet nozzle and venturi section so that supplemental water could be pulled into the annular space between the nozzle and venturi throat from the surrounding body of water without passing through either a horizontal or a vertical intake passageway. This arrangement could be considered as one in which the horizontal and vertical intake passageways had unlimited cross-sectional areas. It was found that the maximum thrust augmentation obtained was about 17% of the basic thrust developed by the water passing through the jet nozzle alone. It appears from this that the augmented thrust obtained in accordance with the invention is not merely a function of the cross-sectional area available for the flow of additional water into the space surrounding the nozzle and that other phenomena are involved.

In still another test, the venturi constriction was removed from the horizontal intake passageway to determine whether this had any effect upon the thrust augmentation obtained. It was found that replacement of this venturi section by a tube of constant diameter had no measurable effect.

FIG. 3 in the drawing is a diagram illustrating the advantages of the system of the invention over conventional thruster systems from the standpoint of location of the horizontal intake passageways. The base line in the diagram represents the bottom of the vessel and the distance "A" is a minimum distance above the vessel bottom determined by the keel, ribs and other structural features of the vessel. The horizontal passageways of the propulsion system cannot be located closer to the bottom than this minimum distance without extensive structural modifications to the vessel itself.

Studies have shown that for a given horsepower input, the diameter of the passageways in the system of the invention need be only about two-thirds of those in a conventional propeller-driven thruster system and that the centerlines of the intake ports should be at least one diameter below the water's surface for maximum efficiency. It can be seen from the diagram of FIG. 3 that this permits a vessel equipped with the system of the invention to operate at shallower draft than one fitted with a conventional propeller-type system. This constitutes an important advantage for the eductor system because it eliminates the need for taking on ballast water to maintain the draft required for propeller-type thrusters.

FIG. 4 in the drawing is a diagram illustrating another important advantage of the system of the invention over conventional propeller-driven thruster systems. Two curves are shown in FIG. 4, one representing the thrust developed by a conventional propeller-driven system with changes in vessel draft and the other representing the thrust developed by the system of the invention with changes in draft. The lower curve shows that the conventional propeller-driven device does not develop any appreciable thrust until the intake port is substantially submerged and that the maximum thrust is not developed until the upper part of the port is one-half diameter below the water line. During unloading operations, vessels equipped with such devices may therefore lose the benefit of the thrusters and thus suffer a loss in maneuverability unless sufficient ballast is taken aboard to maintain the intake port at the required depth. The upper curve in the graph, on the other hand, shows that the water jet eductor device of the invention provides about 60% of the maximum horsepower even though the eductor pipes are fully exposed to air. When the draft of the vessel reaches a point about two-thirds of the minimum for the propeller-driven device, the thrust generated begins to increase rapidly and reaches the maximum rated horsepower at a point where the propeller-driven device is still relatively inefficient. This permits the maneuvering and positioning of ships fitted with the device of the invention regardless of their draft and eliminates the requirement for taking on ballast to permit thruster operations. In the shaded area between the two curves, the device of the invention is significantly more effective than the conventional device.

Figure 5:
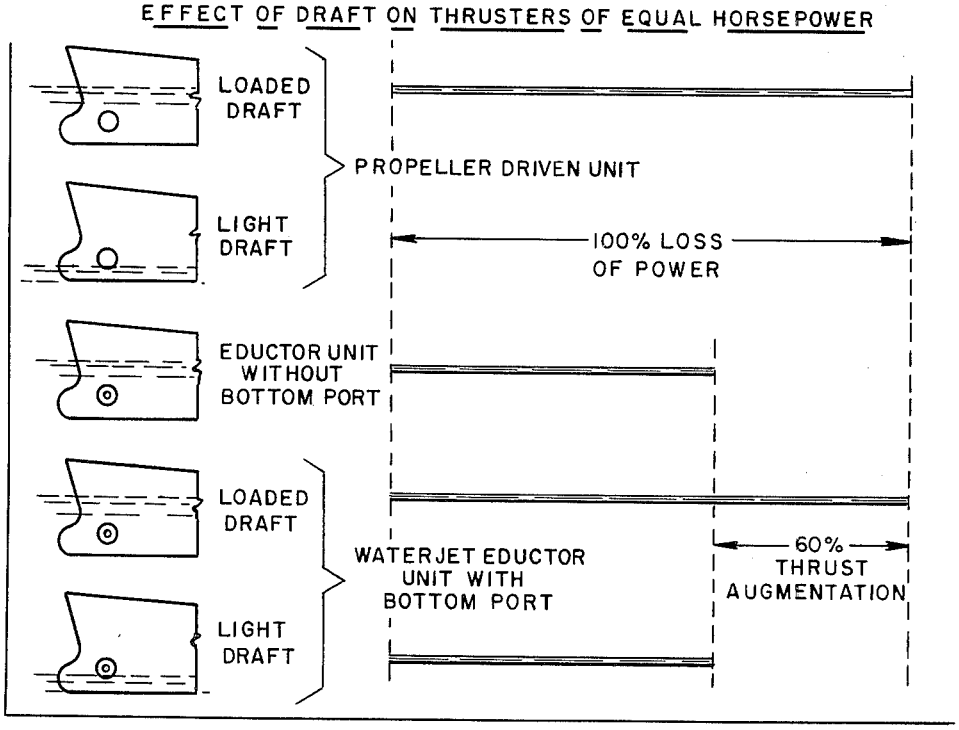
FIG. 5 is a diagram further illustrating the effect of submergence of the propulsion system passageways on conventional systems and the system of the invention.

FIG. 5 in the drawing further illustrates the advantages of the system of the invention over conventional hydraulic propulsion systems. The graph depicts the change in thrust which takes place when vessels fitted with conventional propeller thrusters, with water jet devices having no bottom intake passageways, and with the system of the invention change from a loaded to an unloaded draft state. It is assumed that all three devices have the same installed horsepower and that the system having no bottom intake passageway is otherwise identical to the system of the invention. It can be seen that there is a complete loss of thrust with the propeller-driven system upon exposure of the propulsion passageways. With the system of the invention, the thrust augmentation due to the intake of supplemental water is loss when the propulsion passageways are exposed but the thrust obtained by the discharge of water through the jet nozzle is still available for maneuvering and positioning the vessel. The system having no vertical intake passageway for supplemental water does not undergo any loss of thrust with a change in draft but is less effective under normal loaded conditions than the propeller-driven system.

While the system of the invention has been described up to this point primarily in terms of side thrusters for use in maneuvering drilling ships, barges and similar vessels, it should be apparent that it can also be employed as a primary propulsion device, particularly on barges and other vessels of moderate speed. FIGS. 6 and 7 in the drawing illustrate one such application. The vessel 40 shown in FIGS. 6 and 7 is provided with an internal chamber 41 located in the aft portion of the hull below the water line. A straight, generally horizontal discharge passageway 42 extends from the internal chamber 41 parallel to the longitudinal axis of the vessel to a submerged discharge port 43 in the vessel's stern. Generally horizontal intake passageways 44 and 45 extend inwardly from intake ports 46 and 47 at an angle of about 60° to the longitudinal axis of the vessel. Each of these passageways will normally be contoured to provide a venturi throat near the point at which it enters chamber 41. Nozzle 48 is positioned in the chamber and will normally be made rotatable so that its position can be adjusted to permit discharge into any of the three horizontal passageways. The intake side of the nozzle is connected by line 49 to a pump or other system for supplying water under pressure which is not shown. Vertical passageway 50 extends upwardly into the chamber below the nozzle from bottom intake port 51. The intake port and vertical passageway may be of any desired cross-sectional configuration. As water is discharged through the nozzle into discharge passageway 42, sea water is pulled into the chamber through passageways 44, 45 and 50. This supplemental water augments the thrust developed by the water discharged from the nozzle and facilitates forward propulsion of the vessel. If the system is provided with means for rotating the nozzle, water may be discharged through either of the two other horizontal passageways to maneuver or position the vessel.

FIGS. 8 and 9 in the drawing illustrate another embodiment of the invention which may be used as a primary propulsion device. Here vessel 55 is provided with an internal chamber 56 located below the waterline near the stern of the vessel. A generally horizontal discharge passageway 57 extends from the chamber to a discharge port 58 in the stern. This passageway contains a venturi throat 59 and tapers outwardly from the throat to the discharge port. An intake passageway 60 extends upwardly for a short distance from intake port 61 and then extends in a generally horizontal direction into chamber 56. Bottom intake passageway 62 extends between bottom inlet port 63 and the chamber. Located within the chamber is a fixed nozzle 64 which is aligned with the discharge passageway and positioned to act in conjunction with the venturi throat as an eductor. Seawater is supplied under pressure to the nozzle by means of line 65, connected through a suitable pump to a water intake port not shown. Supplemental water is pulled into the intake passageway 60 through port 61 and into passageway 62 through port 63 as fluid is discharged through nozzle 64 from supply line 65. The augmented thrust thus obtained provides an effective means for propelling the vessel forward. Since the nozzle is mounted in fixed position, no means for reversing the direction of propulsion is provided.

FIGS. 10 and 11 in the drawing illustrate the use of two eductors for propelling and maneuvering a large ship or similar vessel. The hull of the vessel 70 contains a first internal chamber 71 located near the stern below the waterline. Discharge passageway 72 extends in a generally horizontal direction from this chamber to discharge port 73 in the ship's stern. The horizontal passageway is provided with a venturi throat configuration. Vertical bottom intake passageway 74 extends upwardly from bottom of inlet port 75 into the chamber beneath rotatable nozzle 76. The nozzle is connected to water supply line 77 which extends through a suitable bearing and packing arrangement to permit rotation of the nozzle through an angle of 180°. A second internal chamber 78 is located below the waterline near the bow of the vessel. Horizontal passageway 79 extends into the chamber from submerged intake port 80 in the bow. Lateral passageways 81 and 82 connect the chamber with submerged lateral ports 83 and 84. Passageways 79, 81 and 82 are all provided with venturi configurations where they connect with the chamber. Horizontal passageway 85, having a venturi configuration at each end, extends between the two chambers. Vertical bottom intake passageway 86 extends upwardly from bottom intake port 87 into the forward chamber. Rotatable nozzle 88 is positioned in the forward chamber and connected to rotatable line 89, which in turn is connected to a suitable high pressure water supply system. During normal operation of this vessel, nozzle 88 discharges aft into passageway 85, pulling water into the forward chamber through passageways 79, 81, 82 and 86. Nozzle 76 discharges aft into passageway 72, pulling additional water into the aft chamber through passageways 85 and 74. This use of two eductor systems in tandum will generally increase the thrust available for forward propulsion of the ship. When it is desired to maneuver the vessel to the starboard or port, the water supply to the forward nozzle can be interrupted and the nozzle located 90°. The discharge of fluid into the one of the lateral passageways and augmentation of the resulting thrust by water flowing into the chamber through the other horizontal passageway and the vertical passageway provides sufficient thrust to turn the vessel to the port or starboard. To slow down or reverse the vessel, the water supply to both of the nozzles can be interrupted long enough to permit the rotation of both nozzles through an angle of 180° from the position shown in FIG. 10. The subsequent discharge of water through the nozzles and the thrust augmentation obtained by the entry of water through the lateral passageways and bottom intake passageways provides thrust towards the stern of the vessel and thus slows it down or stops it.

In FIGS. 12 and 13, a ship 90 having a conventional propeller 91 and propulsion system and a rudder 92 is equipped with a side thruster system located near the stern. Internal chamber 93 containing rotatable nozzle 94 is located near the stern. Horizontal passageways 95 and 96 having venturi configurations extend from the chamber to lateral ports 97 and 98. A generally vertical bottom intake passageway 99 extends upwardly into the chamber from bottom intake port 100. Use of the side thrusters assists in turning the vessel and provides greater maneuverability than could be obtained by means of the rudder alone. The inclusion of passageway 99 and bottom intake port 100 results in augmentation of the thrust developed by seawater discharged through nozzle 94 and results in a more efficient system than if a conventional thruster were employed.

FIGS. 14 and 15 depict a vessel having a side thruster positioned at a point close to the bow. Chamber 105 is located in the hull below the normal water line and contains rotatable nozzle 106. Horizontal passageways 107 and 108 extend between the chamber and lateral ports 109 and 110. Both passageways are provided with venturi throats. Bottom intake passageway 111 extends upwardly into the chamber from bottom port 112. The nozzle is connected to pump 113 and provided with a rotational system not shown in FIGS. 14 and 15. The pump is driven by means of a drive shaft 114 extending to an engine or other power source 115. The intake of the pump communicates with a generally horizontal intake passageway 116 which extends into the hull in a generally horizontal direction from port 117.

FIG. 16 is an enlarged view of the pump and associated equipment of FIGS. 14 and 15 showing the arrangement of the pump. The nozzle 106 is rotated by means of gears 118 and 119 which are connected to a power source not shown in the drawing. By rotating the nozzle through an angle of 180°, seawater taken in through port 117 and passageway 116 can be discharged into either of the horizontal passageways 107 and 108. Additional water is pulled into chamber 105 through bottom port 112 and bottom intake passageway 111 to augment the thrust obtained. This makes possible significantly higher thrust values than can be obtained with eductor systems not provided with a bottom intake port.

It should be apparent from the foregoing that the invention provides a significant improvement in hydraulic propulsion systems and overcomes many of the disadvantages associated with propeller-driven systems and eductor-type systems used or proposed for use in the past.

I claim:

1. A waterborne vessel comprising a hull containing an internal chamber; a first generally horizontal passageway extending transversely in said hull between said chamber and a first port in one side of the hull; a second generally horizontal passageway extending transversely in said hull between said chamber and a second port in the opposite side of said hull, said first and second passageways being substantially aligned with one another and containing venturi constrictions adjacent said chamber and said chamber, said passageways and said ports being below the waterline when said vessel is in a normal loaded condition; a nozzle positioned within said chamber; means associated with said nozzle for rotating the nozzle between a first position in which the nozzle discharges into said first passageway and a second position in which the nozzle discharges into said second passageway; means for pumping water through said nozzle; and a bottom intake passageway extending upwardly into said chamber beneath said nozzle from a bottom intake port for the continuous influx of water into said chamber.

2. A vessel as defined by claim 1 including a third generally horizontal passageway extending lonitudinally in said hull between said chamber and a third port in said hull, said third generally horizontal passageway containing a venturi constriction adjacent said chamber and said means associated with said nozzle including means for rotating the nozzle into a third position in which said nozzle discharges into said third passageway.

3. A vessel as defined by claim 2 wherein said third passageway extends forward from said chamber and said third port is located near the bow of said vessel.

4. A vessel as defined in claim 2 wherein said third passageway extends aft from said chamber and said third port is located near the stern of said vessel.

5. A vessel as defined by claim 2 including a second jet nozzle positioned in a second chamber located at an intermediate point along with third generally horizontal passageway.

6. In the propulsion of a marine vessel wherein a stream of water is discharged from a jet nozzle into a generally horizontal discharge passageway which contains a venturi constriction and extends in a direction perpendicular to the longitudinal axis of said vessel from an internal chamber surrounding said nozzle to a discharge port in the hull of the vessel for the generation of thrust and wherein supplemental water is admitted into said chamber through a generally horizontal intake passageway extending into said chamber from an intake port in the hull of said vessel to increase the amount of water expelled through said discharge passageway, the improvement which comprises simultaneously admitting additional supplemental water into said chamber adjacent said nozzle through a bottom intake passageway extending upwardly into said chamber beneath the nozzle from a bottom intake port in the hull of the vessel.

7. In the propulsion of a marine vessel wherein a stream of water is discharged from a jet nozzle into a generally horizontal discharge passageway which contains a venturi constriction and extends from an internal chamber surrounding said nozzle to a discharge port in the hull of the vessel for the generation of thrust and wherein supplemental water is simultaneously admitted into said chamber through two generally horizontal passageways extending into the chamber from two separate intake ports in the hull of said vessel to increase the amount of water expelled through said discharge passageway, the improvement which comprises simultaneously admitting additional supplemental water into said chamber adjacent said nozzle through a bottom intake passageway extending upwardly into said chamber beneath the nozzle from a bottom intake port in the hull of the vessel.

8. In the propulsion of a marine vessel wherein a stream of water is discharged from a jet nozzle into a generally horizontal discharge passageway which contains a venturi constriction and extends from an internal chamber surrounding said nozzle to a discharge port in the hull of the vessel for the generation of thrust and wherein supplemental water is admitted into said chamber through a generally horizontal intake passageway extending into said chamber from an intake port in the hull of said vessel to increase the amount of water expelled through said discharge passageway, the improvement which comprises simultaneously admitting additional supplemental water into said chamber adjacent said nozzle through a bottom intake passageway extending upwardly into said chamber beneath the nozzle from a bottom intake port in the hull of the vessel and simultaneously discharging an additional stream of water from a second jet nozzle into said generally horizontal intake passageway at a point in said passageway upstream of said chamber.

* * * * *